US005643097A

United States Patent [19]

Bechler et al.

[11] Patent Number: 5,643,097

[45] Date of Patent: Jul. 1, 1997

[54] HIP ROTATION TRAINING DEVICE

[76] Inventors: Jurgen Bechler, Dachauer Str. 140e, D-80637 Munchen; Hery J. Beer, Schiessstattstr. 56a, D-82515 Wolfratshausen, both of Germany

[21] Appl. No.: 592,940

[22] Filed: Jan. 29, 1996

[30] Foreign Application Priority Data

Jun. 13, 1995 [DE] Germany ..... 195 21 493.5

[51] Int. Cl.[6] ..... A63B 69/36

[52] U.S. Cl. ..... 473/215; 473/277; 273/DIG. 19; 446/28

[58] Field of Search ..... 473/215, 216, 473/277; 273/DIG. 19; 446/28

[56] References Cited

U.S. PATENT DOCUMENTS

| | | | |
|---|---|---|---|
| 1,591,524 | 7/1926 | Fuller | 473/215 |
| 1,669,457 | 5/1928 | Dailey | 473/215 |
| 3,200,536 | 8/1965 | Petitto | 446/28 |
| 3,368,817 | 2/1968 | Duncan | 473/215 |
| 3,610,622 | 10/1971 | Haroski | 446/28 |
| 4,688,800 | 8/1987 | Lopez | 473/215 |
| 5,397,121 | 3/1995 | Gipson et al. | 473/215 |

*Primary Examiner*—George J. Marlo

*Attorney, Agent, or Firm*—Dennison, Meserole, Pollack & Scheiner

[57] ABSTRACT

The invention relates to a device for learning and practicing a correct hip rotation in all types of sports, in particular a correct hip rotation for the execution of an efficient golf swing. The device is a continuous length of wire formed to constitute straight parts which form radially shaped first ends acting as a pointer and angled parts at a second end connected so as to enable fastening in the hip region with the pointer extending essentially radially to the longitudinal axis of the torso to make the rotation of the hips visible during the swing motion. The straight parts may be length adjustable.

9 Claims, 3 Drawing Sheets

HIP ROTATION TRAINING DEVICE

BACKGROUND OF THE INVENTION

The invention relates to a device for learning and practicing a correct hip rotation in all types of sports, in particular a correct hip rotation for the execution of an efficient golf swing.

The significance of the invention will be explained below in terms of golfing, one of the main uses of the device according to the invention. The invention, however, relates generally to all types of sports in which the execution of a correct hip rotation plays an important role, e.g. all throwing disciplines, tennis, baseball, etc. It is not necessary to describe the actual hip motion to be executed or various sport types since the action of the device according to the invention can be easily compared and transferred to each type of sport.

The execution of a correct hip rotation during the golf swing is of appreciable significance for the result of a golf shot, in particular for precision of aim and distance of the shot.

In an optimal stroke motion, the hip axis defined by the pelvic bones moves in a plane which is essentially perpendicular to the longitudinal axis and, slightly inclined in respect to the vertical, axis of the torso. The phases of a stroke motion are schematically represented in FIGS. 4*a*–4*c* or better understanding of the object which forms the basis of the invention.

FIG. 4*a* shows the stance of a golfer with a fully completed backswing, i.e. at the reversal point between backswing and stroke motion. In this position, the hip axis or its protection in a horizontal plane, together with the target line L, which is defined by the golf ball 1 and the hole 3, encompasses an angle of approximately 60° During the swing motion of the golf club 5 toward the golf ball 1, whose first phase is shown in FIG. 4*b*, the torso rotates around its longitudinal axis 0. At the same time, the hip axis H rotates in a plane E perpendicular to the longitudinal axis 0 of the torso. Naturally, the same is also true for the backswing.

All joint and muscle movements of the body, which produce the speed of the club head—and thereby determine the momentum and the kinetic energy of the club head—and which movement are responsible for the flight direction of the ball, are related to the hip motion and its rotation plane. Only a hip rotation which is matched to the arm, club, and shoulder axis assures the correct, efficient golf swing and prevents the club head from leaving the ideal path, which is disposed in a single plane.

Hence, up to the point when the ball is hit, the hip rotation should lead in relation to the shoulder axis motion and arm/club motion and from that moment to the end of the swing should coincide as much as possible with the arm swing motion and leg motion.

Only by means of such coincidence can it be achieved that the momentum of the club head at the point of impact acts on the golf ball in the correct direction. The projection of the movement direction of the club head at the point of impact in a horizontal plane defines the stroke line, which stroke line is shown in FIGS. 4*a*–4*c* by the arrow I. The stroke line I encompasses a definite angle together with the target line L, which is defined by a straight line connecting the hole to be played with the ball. The golfer chooses this angle depending upon relevant factors, such as the ball spin to be imparted, etc. In a "normal, straight shot", this angle is approximately 30° opposite to the rotation direction of the hips during the actual stroke motion.

On the whole, starting from the initial position or addressing position, i.e. in the position in which the club head 5*a* is situated close to the golf ball 1 and in which the hip axis H is essentially parallel to the target line L, during the backswing the hip axis executes a rotation of up to approximately 60° in a first direction, and during the subsequent actual stroke motion a rotation of up to approximately 180° in a second opposite direction.

Up till now, the only option for learning a correct hip rotation during the golf swing was the process used by golf instructors in which the golf club is held in front of the torso of the player in a position parallel to the hip axis and the correct hip rotation during the swing is explained in this manner. But this is only a method of demonstration which is not practicable during the actual swing to be executed by the player.

The same is true for other sports. There, too, in order to explain a correct hip motion or to demonstrate an incorrect one, the instructor would hold a piece of sports equipment, for example the baseball bat, in the hip axis of the person or athlete.

OBJECTS OF THE INVENTION

It is therefore the object of the invention to provide a device for learning and practicing a correct hip rotation in all types of sports, in particular a correct hip rotation for the execution of an efficient golf swing, which makes it possible to observe the actual motion executed during the hip rotation performed by the athlete, in order to thus make it possible or easier for both the player himself and an observer, in particular an instructor, to come up with correction tips.

A device which contains an arm which can be fastened in the hip region of a person and which acts as a pointer extending essentially radially to longitudinal axis of the persons torso making the rotation of the hips observable during a swing motion.

By affixing a pointer in the hip region of an athlete, the athlete himself or an instructor can easily follow the hip motion or hip rotation actually executed so that necessary corrective steps can be taken.

In golfing, the pointer is preferably affixed to the hips in such a way that in the initial position for a stroke, i.e. when the hip axis is parallel to the stroke line, it points in the direction of the stroke line, i.e. that together with the target line, it encompasses an angle of lag of approximately 30° .

This brings the advantage that the pointer not only makes the actually executed hip rotation visible, but it also forces the golfer to execute the release motion, since otherwise the golfer would touch the pointer with his arms. This automatically informs the golfer that the release motion was not correctly executed.

A correspondingly suitable attachment of the pointer in other positions in other types of sports is naturally also possible. For example, the pointer can be attached in such a way that it is disposed in the hip axis.

In the preferred embodiment form of the invention, the device is embodied in such a way that with its one end close to the body, the arm which acts as a pointer can be fastened to the athlete's belt or some other belt on his clothing. By means of this, the device according to the invention can be easily fixed in the hip region of the athlete.

In the preferred embodiment form of the invention, the arm is bent by approximately 90° on its end close to the body, so that the angled part of the arm can be supported on the hip of the athlete. With upright posture, the arm acting as a pointer is consequently disposed in an approximately horizontal direction or perpendicular to the longitudinal axis of the torso.

In an embodiment form of the invention which is particularly simple and inexpensive to manufacture, the device is formed of a wire, wherein the device is constituted by a first and a second straight part forming an arm which, enclosing an acute angle, each extend from the radially outer end of the arm respectively to a first and second angled part, which are each aligned essentially parallel to the body axis and on their respective other ends are connected via a part which extends essentially perpendicular to the body axis.

The part which extends essentially perpendicular to the body axis is preferably embodied as curved corresponding to the hips of the athlete. This produces a good contact and an attachment of the arm to the hips.

To make the executed hip rotation better visible, a body, embodied for example as a sphere, a ball, or a golf ball, can be provided on the outer end of the arm.

In order to be able to adapt the device according to the invention in respect to the length of the arm to the body size of the athlete, the arm can be embodied to be adjustable in length. The adjustability can be achieved here preferably by means of a telescoping length adjustment.

In further embodiment of the device according to the invention, the arm can be firmly connected to a belt, so that the device can also be used with clothing which for its part has no belt or waistband for fastening the device.

DETAILED DESCRIPTION OF THE INVENTION

Figure 1:
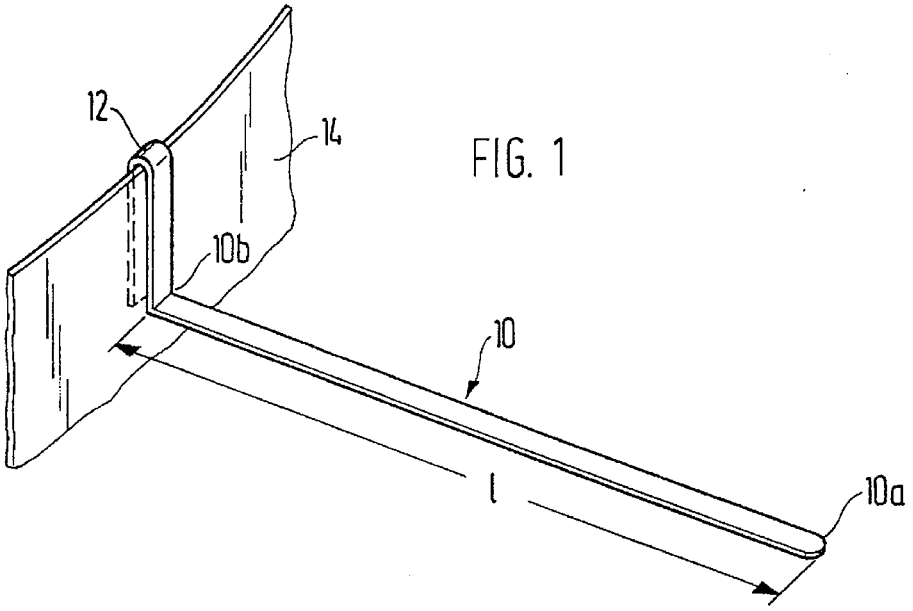
FIG. 1, is a perspective representation of a first embodiment of the device according to the invention.

The device according to the invention shown in FIG. 1 is comprised essentially of an arm 10, which has a predetermined length 1. The length can be varied, depending upon the body size of the golfer using this device, and is preferably in the range of approximately 25 cm–50 cm.

The arm shown in FIG. 1 has a relatively narrow width, wherein the free end 10*a* of the arm is preferably rounded in order to prevent the danger of injury.

An essentially U-shaped bracket 12, whose legs are preferably embodied to be resilient, is provided on the end 10*b* close to the body of the arm 10.

By means of this bracket 12, the device can be fastened to a waistband 14 of an article of clothing, not shown in detail, in the area of the hips of a golfer. In this case the bracket 12 encompasses an angle of approximately 90° with the arm 10, so that after fastening the device at the waistband 14, the arm 10 protrudes from the hips of the golfer at approximately right angles.

The device according to FIG. 1 can be easily and inexpensively manufactured out of a thin sheet metal piece. Naturally, though, other materials are also suitable, for example a sufficiently break-resistant plastic material.

Figure 2:
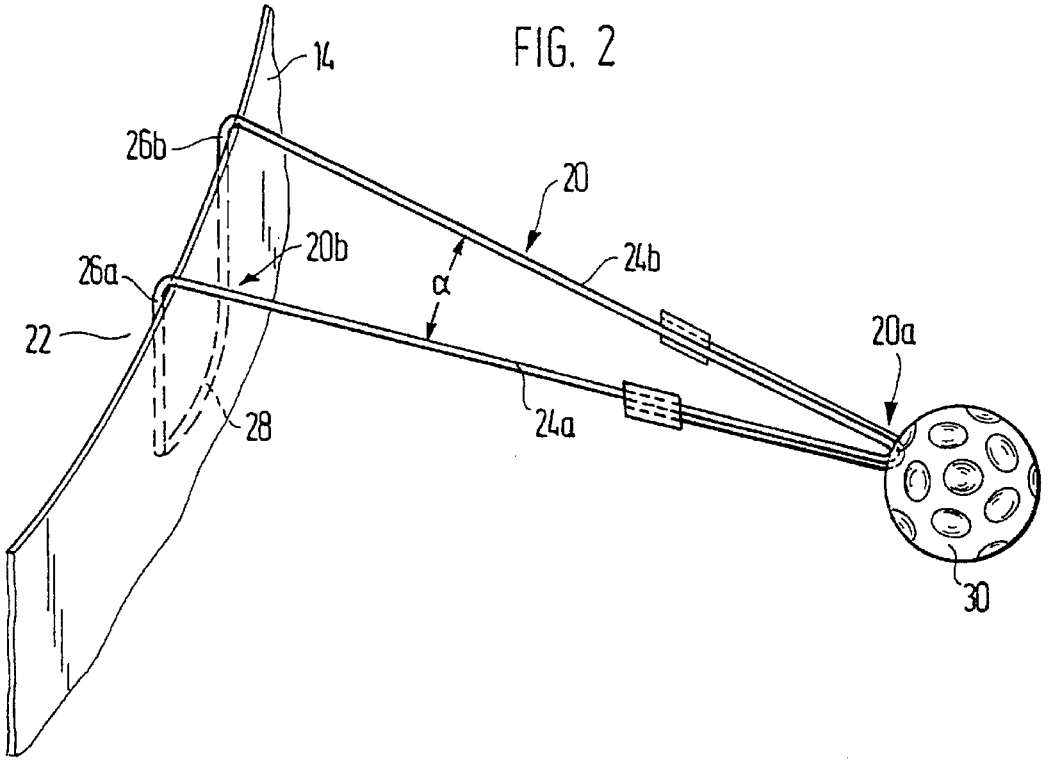
FIG. 2, is a perspective representation of second embodiment of the invention.

The embodiment of the invention shown in FIG. 2 differs from the embodiment according to FIG. 1 essentially in that instead of a bracket on the end 20b close to the body of the arm 20, only region 22 is provided which is essentially bent at right angles.

The arm 20 of the device is comprised of two parts 24*a*, 24*b* which are embodied to be essentially straight and which enclose a slight acute angle α. On their ends close to the body, the parts 24*a*, 24*b* of the arm 20 are angled, wherein the angled parts 26*a*, 26*b* constitute the angled region 22 or the arm 20. The lower ends of the angled parts 26*a*, 26*b* are connected by a connecting part 28.

As shown in FIG. 2, the connecting part 28 can be embodied to be curved in the area of the waistband 14, corresponding to the body shape of the player. This produces an improved attachment of the device and of the arm 20 being used as a pointer.

In order to be better able to follow the course of motion of the outer end 20*a* of the arm 20 according to the hip rotation movement during the golf swing, a body 30, for example in the shape of a golf ball, is provided on the radially outer end of the arm 20. The chronological course of the-hip rotation in relation to the torso rotation is thus also easily discernible.

The device according to the invention shown in FIG. 2 can be manufactured for example of a single piece of wire, which is bent at the four points defining the angled region 22, according to the shape desired. Then the body 30 only has to be slid onto and fastened to the two free ends constituting the radially outer ends 20a of the arm 20.

In order to make the length of arm 20 adjustable, so as to correspond to the height of the user, the device may be formed from two portions so that one arm portion corresponds in a telescoping function with a second arm portion. Adjustment of the arm length between 25 and 50 cm is contemplated.

The invention is not limited to the two embodiments shown in FIGS. 1 and 2, but essentially relates to creating an arm or pointer which can be fastened to the hips in any way. Thus, for example, in an embodiment of the invention not shown in detail, the end of an arm close to the body can be firmly connected to a belt, so that the device can also be used by golfers whose clothing has no waistband in the hip region.

The preferred use of the device according to the invention is explained below by means of the representation in FIG. 3.

Figure 3:
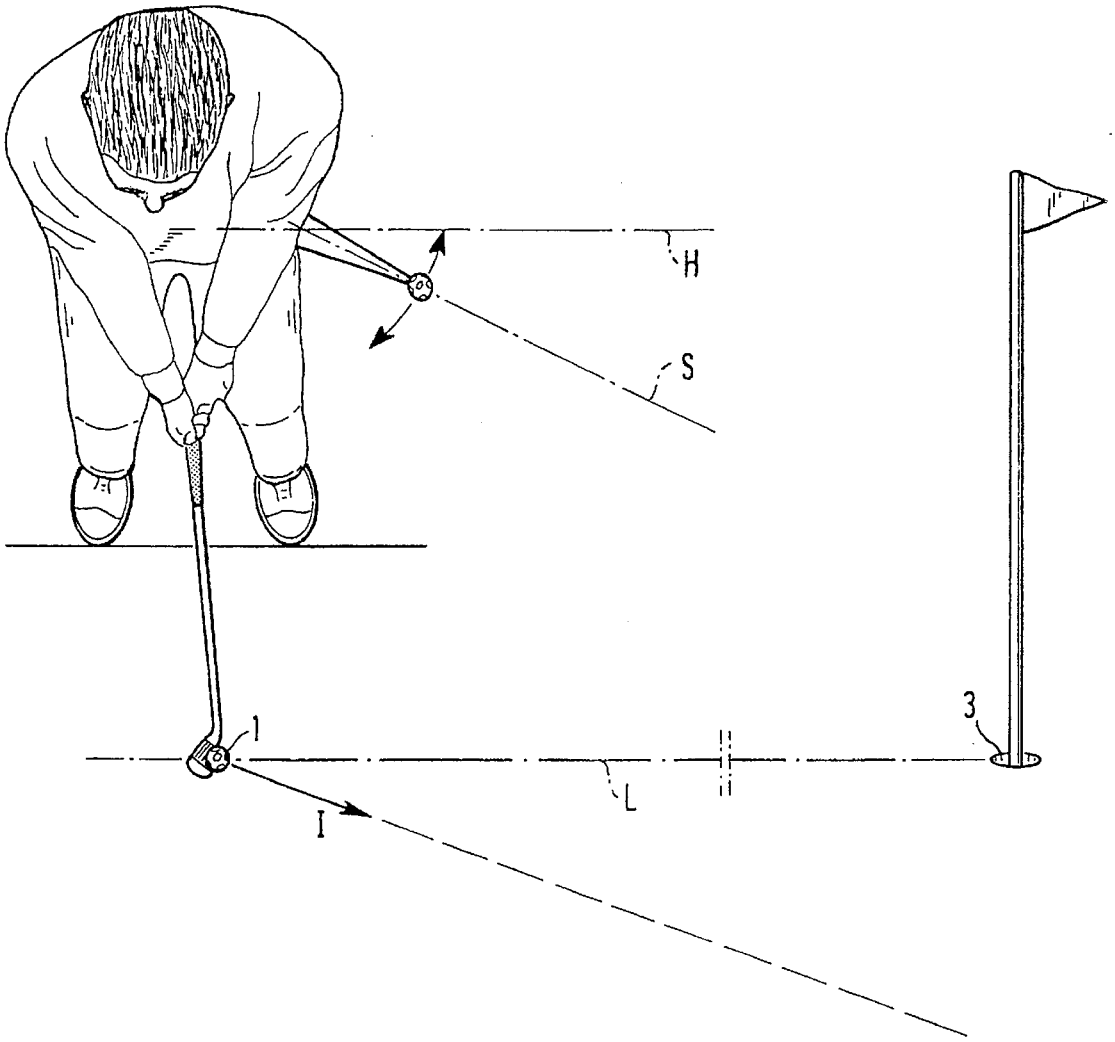
FIG. 3, is a perspective representation of a golfer using a device in accordance with the invention.

FIG. 3 shows a player holding a golf club in the initial position before the start of the swing motion. A device according to the invention, for example the device according to FIG. 2, is fastened to the left hip of the golfer. In this case the arm 20 of the device is fastened in a position in which the longitudinal axis or symmetry axis S of the arm 20, together with the golfer's hip axis H, encompasses an angle of approximately 30° in the direction toward the front of the golfer. In the initial position shown in FIG. 3, in which the hip axis H is aligned parallel to the target line L between golf ball 1 and hole 3, the arm 20 or its longitudinal or symmetry axis S points exactly in the direction of the stroke direction I in the case of a "normal, straight" shot.

Figure 4C:
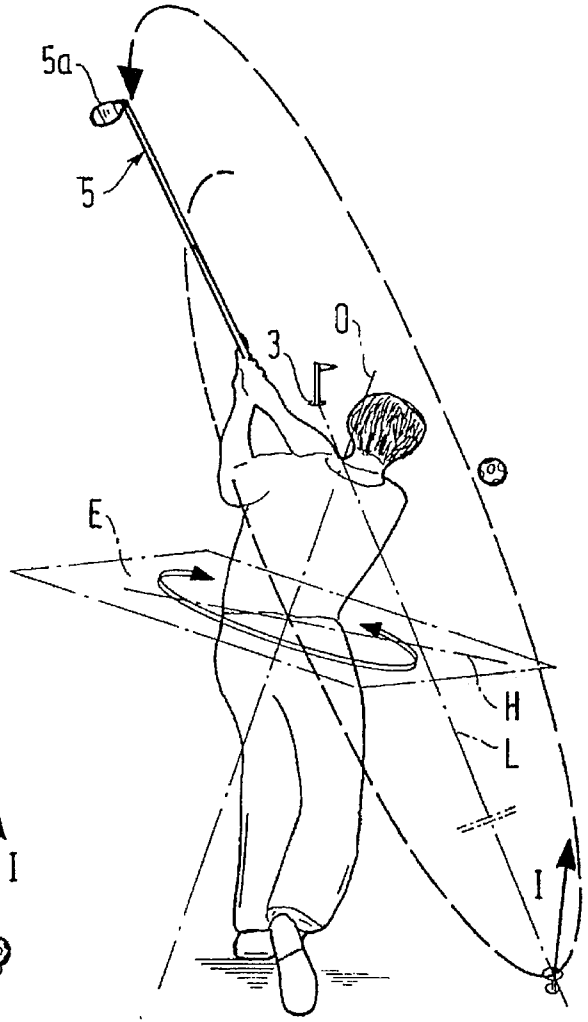
FIG. 4*c* shows a golfer near the end of the swing motion.
Figure 4B:
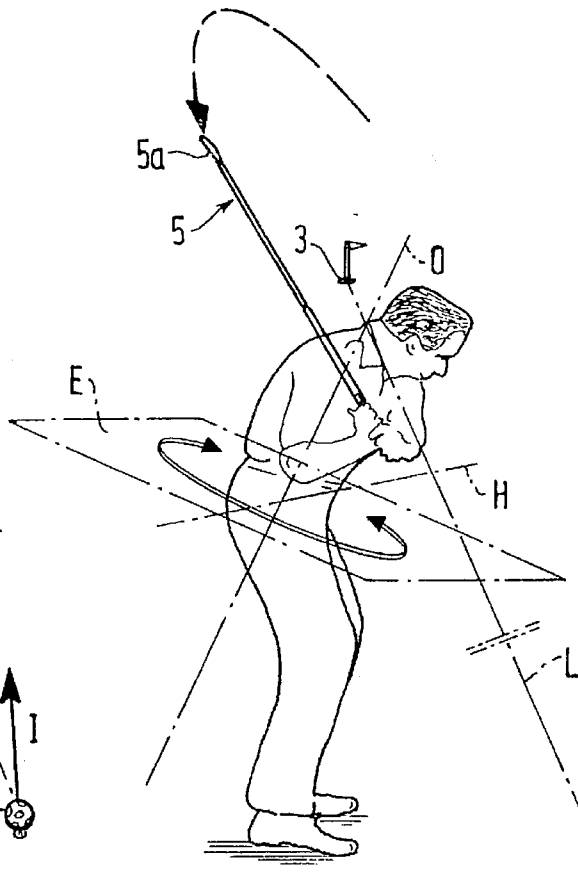
FIG. 4*b* shows a golfer during the swing motion.
Figure 4A:
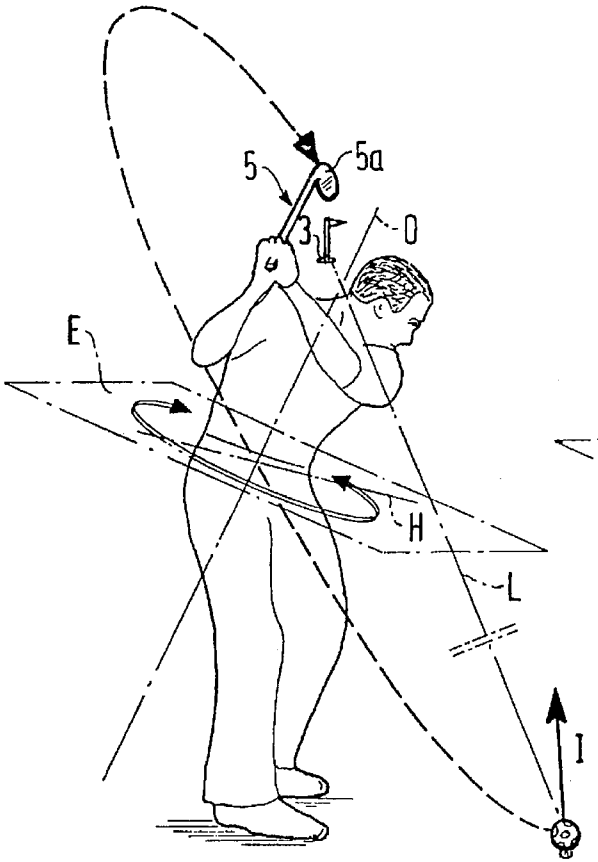
FIG. 4*a* shows a golfer with a complete backswing.

The actual course of the hip rotation during the entire golf swing can be observed in this manner by means of the arm 20. Deviations from the optimal swing motion, explained at the by means of FIGS. 4*a*–4*c*, can be easily recognized and corrected in this manner. Thus, for example, fluctuations of the hip rotation axis can be discerned by an up and down motion of the pointer tip, stiff hips can be discerned by a stationary pointer tip, and a drifting hip can be discerned by an overlapping linear motion of the pointer tip. The golfer or instructor can immediately spot the "passing effect" indicated by the arm of the device when there is a non-simultaneous motion of the shoulder rotation and hip rotation, and know which motion needs to be accelerated and which needs to be delayed.

Furthermore, the golfer learns to line up in a target-oriented manner by means of the device according to the invention. In addition, in a further embodiment, not shown, of the invention, a second arm can be provided, wherein the entire device is fastened to the hips in such a way that in the initial position one pointer is aligned parallel to the target line and the second pointer, which together with the first pointer encompasses an angle of approximately 30° , then automatically points in the direction of the stroke line. In actual use, though, it has turned out that it is sufficient to use a single pointer which points in the direction of the stroke line in the initial position.

We claim:

1. A device enabling a person to observe his hip rotation during the execution of a swing motion, said device comprising:

a continuous length of wire formed so as to constitute first and second straight parts, first free ends of said straight parts enclosing an acute angle forming radially outer ends, angled parts at second ends of each of said first and second straight parts and a part connecting said angled parts, said angled and connecting parts enabling fastening in the hip region of the person by means of a belt so that the angled parts are aligned substantially parallel to a body axis of the person, said first and second straight parts form an arm which extends substantially perpendicular to the body axis, hip rotation being indicated by movement of said radially shaped end.

2. The device according to claim 1, wherein said first and second straight parts includes means for adjusting the length.

3. The device according to claim 2, wherein said means for adjusting is a telescoping length arrangement.

4. The device of claim 3, wherein the length of said first and second straight parts is adjustable in the range of 25 to 50 cm so as to fit the body size of the person.

5. The device according to claim 1, wherein the part connecting the angled parts is curved according to the curvature of the person's hip.

6. The device according to claim 1, further including visible means attached at said radially shaped end to make movement more easily observable.

7. The device according to claim 6, wherein said visible means is a sphere.

8. The device according to claim 7, wherein said visible means is in form of a golf ball.

9. A device enabling a person to observe his hip rotation during the execution of a swing motion, said device comprising:

a continuous length of wire formed so as to constitute first and second straight parts, first ends of said parts enclosing an acute angle forming radially outer ends, said straight parts having a length in a range between 25 to 50 cm, angled parts at second ends of each of said first and second parts and a part connecting said angled parts, said angled and connecting parts enabling fastening in the hip region of the person by means of a belt so that the angled parts are aligned substantially parallel to a body axis of the person, said first and second straight parts form an arm which extends substantially perpendicular to the body axis, hip rotation being indicated by movement of said radially shaped end.

* * * * *